United States Patent [19]

West

[11] Patent Number: 4,953,859

[45] Date of Patent: Sep. 4, 1990

[54] GAME DEVICE

[76] Inventor: Allen D. West, Drawer 310, Catoosa, Okla. 74015

[21] Appl. No.: 415,659

[22] Filed: Oct. 2, 1989

[51] Int. Cl.[5] ..... A63F 9/06

[52] U.S. Cl. ..... 273/1 GA; 434/261

[58] Field of Search ..... 273/1 GC, 1 GD; 434/261; 292/268

[56] References Cited

U.S. PATENT DOCUMENTS

| | | | |
|---|---|---|---|
| 898,833 | 9/1908 | Chapman | 273/1 GA X |
| 959,843 | 5/1910 | Cox et al. | 292/268 X |
| 1,522,636 | 1/1925 | Landine | 292/268 X |
| 1,987,695 | 1/1935 | McDonald | 273/1 GB X |
| 2,848,783 | 8/1958 | Keller, Jr. et al. | 292/268 X |
| 4,193,594 | 3/1980 | Schwauss | 273/1 GA |

OTHER PUBLICATIONS

Psychological and Physiological Apparatus and Supplies, C. H. Stoelting Co. 1930, pp. 143 & 144, #31213 & #31223.

*Primary Examiner*—Paul E. Shapiro
*Attorney, Agent, or Firm*—Head and Johnson

[57] ABSTRACT

A game device having a horizontal base for receiving a drawing sheet thereon, a back board extending upwardly from the base supporting a mirror, and a front board extending upwardly from the base and spaced from the back board, the front board having an opening in the bottom portion thereof through which the user's hand and forearm can extend, and a drawing sheet on the board, the user views the drawing sheet by looking into the mirror over the top of the front board to see a reflection thereof.

4 Claims, 2 Drawing Sheets

GAME DEVICE

SUMMARY OF THE INVENTION

The purpose of the present invention is to provide an improved game in which a design is traced by a player viewing the image of the design through a mirror. The game, in its preferred form, is stored as a foldable, compact case which can be quickly opened and set up for use in play. The game is positioned on a table or desk, and the user sits in front of the game. The game includes a horizontal base which has a flat top surface dimensioned to receive a drawing sheet thereon. The base has a front edge and a rear edge. A back board extends upwardly from the base rear edge and has a forward surface. A mirror is attached to the back board forward surface.

A front board extends upwardly from the base front edge and has an opening in the lower portion thereof through which a user can extend his/her hand and forearm. The front board has an upper top edge.

A drawing sheet is supported on the base top surface. The drawing sheet may include one or more figures to be traced.

To use the game device, the user extends his/her hand and forearm through the opening in the front board, with a pencil. The user views the drawing sheet by peering over the top of the front board into the mirror, and observes a reflection of the drawing sheet along with his/her hand and the pencil in the mirror. Direct view of the drawing sheet and hand and pencil is occluded by the upper portion of the front board. The user then either makes or follows a design by observation of the drawing sheet through the mirror.

In the preferred arrangement the back board and front board are each pivoted to the base so that when the game device is to be in the stored position, these members may be pivoted to lie parallel the base to form a compact, easily transportable case. In a further preferred embodiment, slide locks are provided so that the back board and front board are easily held in upright positions when the game is in use, or released for folding into the stored position.

Others have provided games wherein the viewer looks at a drawing sheet through a mirror, and for reference to such prior devices see the following U.S. Pat Nos.: 1,757,287; 1,970,035; 2,197,483; 3,361,131; 3,074,319; 4,193,594; 4,746,123; 4,353,621 and 3,419,971.

While these patents show useful game devices, none show a device which provides the ease and comfort of use in a manner provided by the present disclosure.

A better understanding of the invention will be had by reference to the following description and claims, taken in conjunction with the attached drawings.

DESCRIPTION OF THE PREFERRED EMBODIMENT

Figure 1:
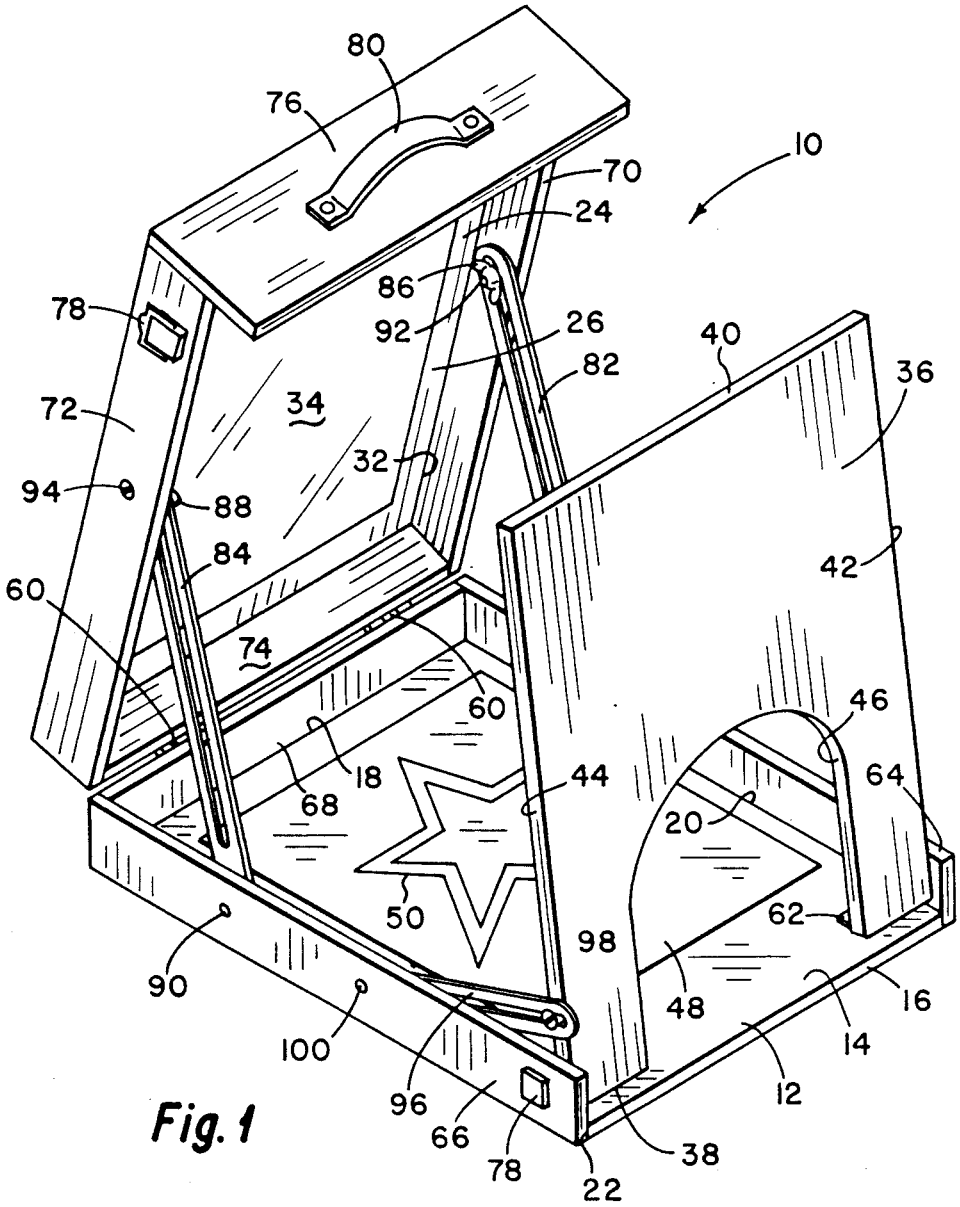
FIG. 1 is an isometric view of a preferred embodiment of the game device of this disclosure setup for use by a user.
Figure 2:
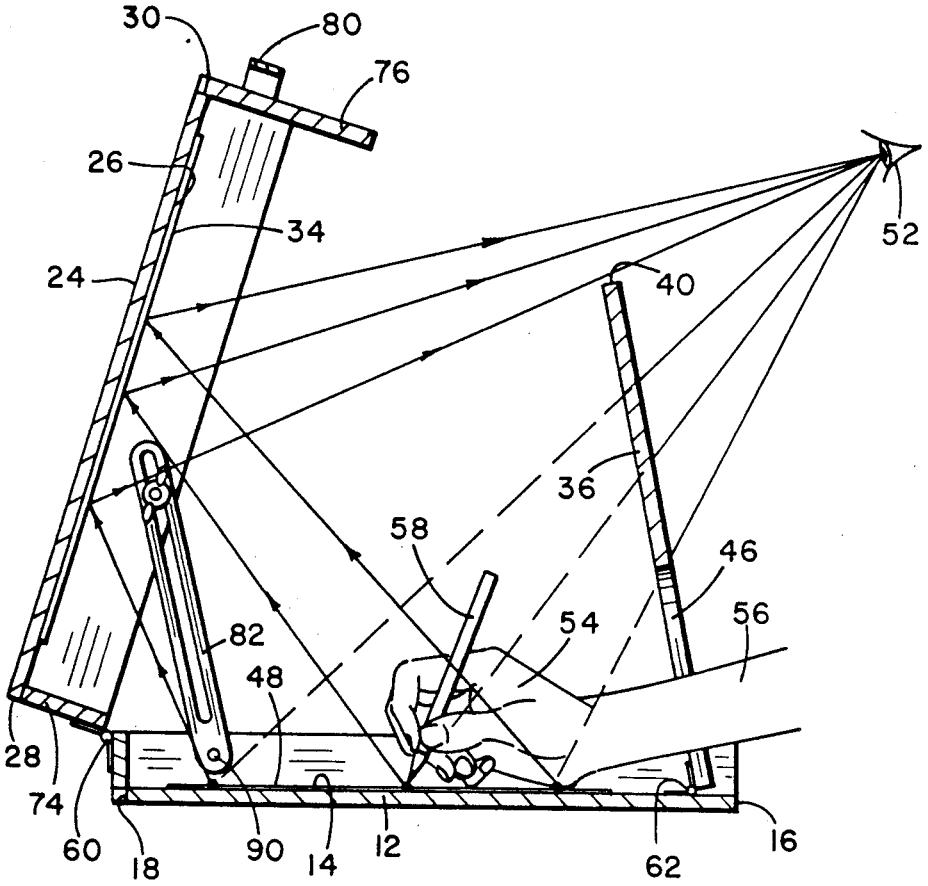
FIG. 2 is an elevational cross-sectional view of the game device as setup in FIG. 1 and showing how a user observes a drawing sheet through a mirror so he/she can create or trace designs on the drawing sheet.

Referring to FIGS. 1 and 2, a preferred embodiment of the disclosure is illustrated. The game device is indicated generally by the numeral 10. The game is to be used on a table or desk (not shown) so that it is supported at normal writing height. The user sits in front of the game. The game device includes a base 12 having a top surface 14, a front edge 16, a rear edge 18, a first side edge 20, and a second side edge 22. Pivotally secured to base 12 adjacent the rear edge 18 is a back board 24 which has a forward surface 26, a bottom edge 28, a top edge 30, a first side edge 32, and a second side edge which is not seen but which is opposite and parallel to the first side edge 32.

Affixed to the back board forward surface 26 is a mirror 34, the mirror being approximately the dimensions but somewhat smaller than the back board.

Supported to the base 12 adjacent the front edge 16 is a front board 36. The front board has a lower edge 38 and an upper edge 40 with opposed side edges 42 and 44. An inverted U-shaped cutout 46 is formed in the bottom portion of front board 36, with the cutout extending to the lower edge 38.

Positioned on the top surface 14 of the base board 12 is a drawing sheet 48. The drawing sheet can be blank or can have one or more figures 50 thereon. In the arrangement illustrated in FIG. 1, drawing sheet 48 has a star shaped figure 50 in which the star is formed by parallel lines.

The elements described to this point are those which are important in the practice of the game device, and reference may be had to FIG. 2 to show the method of use. In this elevational cross-sectional view, the eye 52, the hand 54, and the forearm 56 of a user are illustrated. Hand 54 holds a pencil or other type of writing instrument 58. The user can observe the drawing sheet 48 by looking over the upper edge 40 of the front board 36 into mirror 34. With the back board 24 properly inclined relative to the base 12 according to the relationship of the game device to the user, the user is permitted to see the drawing sheet 48 only as a reflection in mirror 34. The front board 36 occludes direct view of the drawing sheet.

Games can be played using the device in a variety of ways, such as by requiring the user to trace an outline between the inside and outside outline of star 50 of FIG. 1 without touching either of the lines within a limited time. This requires hand/eye coordination which is difficult since the viewer's observation of the movement of writing instrument 58 is completely different from that when the writing instrument is directly observed. Other games can be played by requiring the user to draw certain items, such as an outline of a car on a blank sheet of paper within a limited time, or the sheet 48 may have a number of different figures which must be traced within a given length of time.

In the preferred arrangement, the back board 24 and front board 36 are pivotally supported to base 12 so that the boards can be folded into positions generally parallel to base 12 for storage and transportation. For this purpose, hinges 60 pivotally support back board 24, and hinges 62 (only one of which is seen) pivotally support front board 36.

Figure 3:
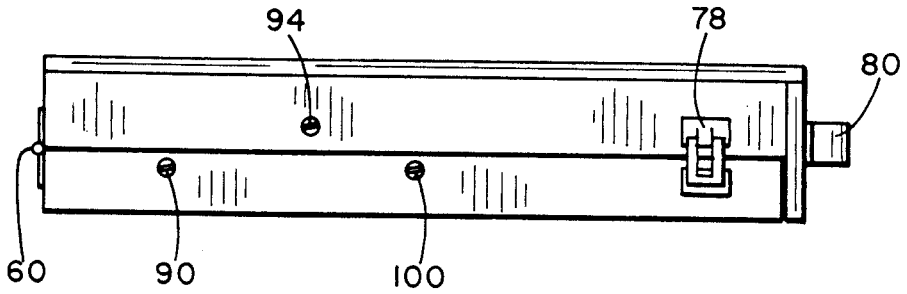
FIG. 3 is a side elevational view of the device in the closed position for convenience of storage or ease of transporation.

The most preferred embodiment of the disclosure is illustrated in FIG. 1. The base board 12 is provided with short height border members 64 and 66 affixed to opposed edges 20 and 22, and border member 68 is affixed to the rear edge 18. In like manner, top board 24 has border boards 70 and 72 affixed to the opposed edges, and a border board 74 affixed to the bottom edge 28. An increased height border board 76 is affixed to the top edge 30. With the use of border boards 64-76 a suitcase type structure is provided so that the front board 36 may be folded into position parallel to the base board 12, and the top board 24 lowered to form a complete enclosure, as shown in FIG. 3. By means of latches 78, only one of which is seen in FIG. 3, the device is held in the closed position. A carrying strap 80 is affixed to front board 76. This preferred arrangement forming a suitcase type enclosure provides facilities for retaining a supply of drawing sheets 48 therein, marking instruments 58, rules of play, and a timer (not shown), and other items which may be employed in using the game device.

In order to retain the back board 26 in proper upright position, slides 82 and 84 are retained with wing nuts 86 and 88. Slides 82 and 84 are pivoted to the border members 64 and 66, respectively, by pins 90. Bolts 92 and 94 extend through border members 70 and 72, respectively, and receive the wing nuts 86 and 88. By loosening the wing nuts 86 and 88, top board 24 may be pivoted to the open or closed position with respect to base 12.

In a similar arrangement, the front board 36 is held in upright position by slides 96 (only one of which is shown), received by bolts 98 and 100. Obviously, other means may be provided for retaining front board 36 and back board 24 in upright positions relative to base 12.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A game device comprising:

a horizontal base having a top flat surface dimensioned to receive a drawing sheet thereon and having a front edge and a rear edge;

a back board extending upwardly from adjacent said base rear edge and having a forward surface;

a mirror supported to said back board forward surface;

a front board having a top edge and a bottom edge, the bottom edge being secured to said base adjacent said front edge thereof and extending uprightly therefrom, the front board having an opening in the lower portion thereof communicating with said lower edge, the opening being dimensioned to loosely receive the hand and forearm of a user therethrough;

a drawing sheet supported on said base top surface, said opening in the lower portion of said front board providing means for the user to extend his/her hand therethrough whereby the user can peer over said top edge of said front board into said mirror to view a reflection of said drawing sheet and whereby the user may view a drawing made by him/her on said drawing sheet as reflected in said mirror, the top portion of said front board occluding the user's direct view of said drawing sheet.

2. A game device according to claim 1 wherein back board is pivoted to said base and wherein said front board at said lower edge thereof is pivoted to said base whereby said back and front boards may be pivoted to storage position generally parallel to said base.

3. A game device according to claim 2 wherein said base has opposed parallel side edges and including vertical short height border members affixed perpendicularly to said base side edges and said rear edge, said back board bottom edge being pivoted to the side member affixed to said base back edge and wherein said back board has short height perpendicularly extending border members which when said back board is folded to lie parallel said base cooperate with said back border members to form a closed box encompassing said front board when folded to lie parallel to said base.

4. A game device according to claim 5 wherein said front board and said back board are pivoted to said base and including means to removably retain said front and back boards in generally upright relationship to said base when said game device is in use.

* * * * *